US008597501B2

(12) United States Patent
Krupa et al.

(10) Patent No.: US 8,597,501 B2
(45) Date of Patent: Dec. 3, 2013

(54) PROCESS FOR REMOVING ONE OR MORE SULFUR COMPOUNDS FROM A STREAM

(75) Inventors: Steven Lee Krupa, Fox River Grove, IL (US); Cedric R. Freeman, Houston, TX (US); Jessy E. Trucko, Lake Forest, IL (US); Jonathan Andrew Tertel, Mt. Prospect, IL (US)

(73) Assignee: UOP LLC, Des Plaines, IL (US)

( * ) Notice: Subject to any disclaimer, the term of this patent is extended or adjusted under 35 U.S.C. 154(b) by 259 days.

(21) Appl. No.: 13/007,583

(22) Filed: Jan. 14, 2011

(65) Prior Publication Data

US 2012/0000827 A1 Jan. 5, 2012

Related U.S. Application Data

(60) Provisional application No. 61/360,321, filed on Jun. 30, 2010.

(51) Int. Cl.
*C10G 19/08* (2006.01)
*C10G 19/00* (2006.01)

(52) U.S. Cl.
USPC ..... 208/235; 208/177; 208/208 R; 208/226; 208/230

(58) Field of Classification Search
USPC ..... 208/235, 177, 208 R, 226, 230
See application file for complete search history.

(56) References Cited

U.S. PATENT DOCUMENTS 2,431,770 A 12/1947 Payne et al.
2,616,833 A 11/1952 Chenicek et al.
2,719,109 A 9/1955 Harper et al.
2,740,749 A 4/1956 Meguerian et al.
2,921,020 A 1/1960 Urban et al.
2,937,986 A 5/1960 Lukk
3,107,213 A 10/1963 Cole et al.
3,260,665 A 7/1966 Urban
3,574,093 A 4/1971 Strong
3,708,421 A 1/1973 Ripple
3,923,645 A 12/1975 Anderson, Jr. et al.
3,980,582 A 9/1976 Anderson, Jr. et al.
4,049,572 A 9/1977 Douglas
4,090,954 A 5/1978 Ward
4,562,300 A * 12/1985 LaFoy ..... 585/854
4,626,341 A 12/1986 Verachtert
4,705,620 A 11/1987 Bricker et al.
4,875,997 A 10/1989 Langford
4,897,180 A 1/1990 Bricker et al.
4,956,324 A 9/1990 Pollastrini et al.
4,973,764 A 11/1990 Oswald et al.
5,112,536 A 5/1992 McNulty et al.
5,157,201 A * 10/1992 Norris ..... 585/820

(Continued)

OTHER PUBLICATIONS

Perry's Chemical Engineer's Handbook, 2008, 8th Ed., pp. 15-6-15-13 & 15-70-15-76.*

(Continued)

*Primary Examiner* — Walter D Griffin
*Assistant Examiner* — Derek Mueller
(74) *Attorney, Agent, or Firm* — James C Paschall

(57) ABSTRACT

One exemplary embodiment can be a process for removing one or more disulfide compounds from a caustic stream. The process can include passing the caustic stream, previously contacted with a hydrocarbon stream for removing one or more mercaptans, through a column to remove the one or more disulfide compounds downstream of a mercaptan oxidation zone.

15 Claims, 4 Drawing Sheets

(56) References Cited

U.S. PATENT DOCUMENTS

| | | | | |
|---|---|---|---|---|
| 6,387,348 | B1 | 5/2002 | Ferrell et al. | |
| 6,565,740 | B2 | 5/2003 | Sain et al. | |
| 6,749,741 | B1 | 6/2004 | Laricchia et al. | |
| 7,326,333 | B2 | 2/2008 | Laricchia et al. | |
| 7,381,309 | B1 | 6/2008 | Laricchia et al. | |
| 7,588,627 | B2 | 9/2009 | Kijlstra et al. | |
| 2004/0175307 | A1 | 9/2004 | Laricchia et al. | |
| 2004/0188327 | A1 | 9/2004 | Groten | |
| 2006/0260981 | A1 * | 11/2006 | Gosling | 208/59 |
| 2008/0085400 | A1 | 4/2008 | Nieuwoudt | |
| 2009/0065434 | A1 | 3/2009 | Zhang | |
| 2009/0145807 | A1 * | 6/2009 | Choi et al. | 208/211 |

OTHER PUBLICATIONS

Akhmetov et al., "Utilization of the Products of Mercaptan Removal from [Light] Hydrocarbon Feedstocks", Khimiya i Tekhnologiya Topliv i Masel, 1999, No. 3, pp. 8-9.

Koncsag et al., "Modelling the Removal of Mercaptans from Liquid Hydrocarbon Streams in Structured Packing Columns", Chemical Engineering and Processing, 2008, vol. 47, No. 9-10, pp. 1717-1725.

Leshchev et al., "New Extractants for Effective Removal of Mercaptans from Hydrocarbon Feedstocks", Neftekhimiya, Mar.-Apr. 1993, vol. 33, No. 2, pp. 186-190.

N.P. Lieberman, "Refinery Feedstock Cleanup Woes Fall Into Six Major Categories", Oil & Gas Journal, Jan. 14, 1980, vol. 78, No. 2, pp. 97-98, 103-104.

Pan et al., "Removal of Mercaptans from Light Fractions of FCC Naptha by Caustic Extraction", Petroleum Processing and Petrochemicals, 2005, vol. 36, No. 10, pp. 24-27.

Wang et al., "Mass-Transfer Characteristics for Gas-Liquid Reaction of H2S and Sulfuric Acid in a Packed Column", Industrial and Engineering Chemistry Research, 2004, vol. 43, No. 18, pp. 5846-5853.

U.S. Appl. No. 10/153,757, filed May 22, 2002, Towler et al.

Office Action dated Aug. 5, 2004 for U.S. Appl. No. 10/153,757, Towler et al.

Applicants' Nov. 5, 2004 Response to the Office Action dated Aug. 5, 2004 for U.S. Appl. No. 10/153,757, Towler et al.

Office Action dated Jan. 10, 2005 for U.S. Appl. No. 10/153,757, Towler et al.

Applicants' Apr. 11, 2005 Response to the Office Action dated Jan. 10, 2005 for U.S. Appl. No. 10/153,757, Towler et al.

Final Office Action dated May 25, 2005 for U.S. Appl. No. 10/153,757, Towler et al.

Applicants' Jun. 22, 2005 Response to the Final Office Action dated May 25, 2005 for U.S. Appl. No. 10/153,757, Towler et al.

Advisory Action dated Jul. 6, 2005 for U.S. Appl. No. 10/153,757, Towler et al.

Notice of Abandonment dated Mar. 7, 2006 for U.S. Appl. No. 10/153,757, Towler et al.

Handbook of Petroleum Refining Processes, (Robert A. Meyers, 2d ed., 1997), pp. 11.30-11.31 by D.L. Holbrook.

* cited by examiner

PROCESS FOR REMOVING ONE OR MORE SULFUR COMPOUNDS FROM A STREAM

CROSS-REFERENCE TO RELATED APPLICATIONS

This application claims the benefit of U.S. Provisional Application No. 61/360,321 filed Jun. 30, 2010, which is hereby incorporated by reference in its entirety.

FIELD OF THE INVENTION

This invention generally relates to a process for removing one or more sulfur compounds from a stream.

DESCRIPTION OF THE RELATED ART

A sulfur removal process can extract mercaptan from a hydrocarbon stream to a caustic stream. Subsequently, the caustic stream can be oxidized to convert the mercaptans to one or more disulfides. When disulfides form, the majority can separate from the caustic in the disulfide separator. As such, the caustic can be removed as a separate phase. Although at least a majority of the disulfide has been removed, some amount of disulfide can remain in the caustic that can be extracted back into the product hydrocarbon and contribute to the overall sulfur in a hydrocarbon product.

Often to reduce the amount of disulfide in the caustic, a series of mixers and settlers can contact the caustic with a sulfur-free oil to remove the disulfide oil from the lean caustic. To attain lower levels of disulfide, additional mixers or settlers may be provided. Generally, minimizing additional mixer/settler combinations is desired due to the extra capital investment. As refiners and chemical manufacturers have to meet more stringent sulfur specifications, increased reduction in the disulfide amounts is desired. However, adding additional mixers and settlers can increase capital and operating costs. As a consequence, there is a desire to achieve the required specifications while minimizing costs. Moreover, accumulated disulfides from the lean caustic can accumulate in the hydrocarbon product, which may be subsequently removed by an adsorptive removal process that may add capital and utility cost to the project. Thus, any reduction of the amount of disulfide in the lean caustic can avoid the cost of subsequent removal in downstream treatment zones for the hydrocarbon product.

SUMMARY OF THE INVENTION

One exemplary embodiment can be a process for removing one or more disulfide compounds from a caustic stream. The process can include passing the caustic stream, previously contacted with a hydrocarbon stream for removing one or more mercaptans, through a column to remove the one or more disulfide compounds downstream of a mercaptan oxidation zone.

Another exemplary embodiment may be a process for removing one or more disulfide compounds from a caustic stream. The process can include passing the caustic stream, previously contacted with a hydrocarbon stream for removing one or more mercaptans, through a packed column to remove the one or more disulfide compounds downstream of a mercaptan oxidation zone.

A further exemplary embodiment can be a process for removing one or more disulfide compounds from a caustic stream. The process may include passing the caustic stream, previously contacted with a hydrocarbon stream for removing one or more mercaptans, through a column having one or more trays to remove the one or more disulfide compounds downstream of a mercaptan oxidation zone; where at least one tray forms a pan communicating via a downcomer with an adjacent tray.

The embodiments disclosed herein can provide a column to remove one or more disulfide compounds. Particularly, the disulfide-tainted caustic can be contacted with a solvent stream, typically including hydrocarbons, to remove the one or more disulfide compounds. As such, the resulting caustic stream can have a lowered disulfide content and can be used, for example, to extract mercaptans from the hydrocarbon stream while significantly reducing or eliminating the undesired reverse-extraction of the one or more disulfide compounds from the regenerated caustic back into the hydrocarbon product stream in the extractor vessel. Thus, the hydrocarbon product stream may have an overall lowered sulfur content and may avoid the necessity of subsequent sulfur removal processes. Moreover, adsorptive removal of one or more disulfides from a caustic to a very low level may allow an increase in caustic circulation, thereby improving the removal of mercaptans in an extraction zone, without substantially incurring increased re-entry of one or more disulfides from the regenerated caustic in the extraction zone into a hydrocarbon product stream.

Definitions

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more. In addition, the term "stream" may be applicable to other fluids, such as aqueous and non-aqueous solutions of alkaline or basic compounds, such as sodium hydroxide.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by weight, of a compound or class of compounds in a stream.

As used herein, the term "substantially" can mean an amount of at least generally about 80%, preferably about 90%, and optimally about 99%, by weight, of a compound or class of compounds in a stream.

As used herein, the term "adsorption" can collectively refer to several processes, and may include processes such as absorption as well as adsorption.

As used herein, the term "parts per million" may be abbreviated herein as "ppm" and "weight ppm" may be abbreviated herein as "wppm".

As used herein, the term "mercaptan" means thiol and can include compounds of the formula RSH as well as salts thereof, such as mercaptides of the formula $RS^-M^+$ where R is a hydrocarbon group, such as an alkyl or aryl group, that is saturated or unsaturated and optionally substituted, and M is a metal, such as sodium or potassium.

As used herein, the term "disulfides" can include dimethyldisulfide, diethyldisulfide, and ethylmethyldisulfide, and possibly other species having the molecular formula RSSR' where R and R' are each, independently, a hydrocarbon group, such as an alkyl or aryl group, that is saturated or unsaturated and optionally substituted. Typically, a disulfide is generated from the oxidation of a mercaptan-tainted caustic and forms a separate hydrocarbon phase that is not soluble in the aqueous caustic phase. Generally, the term "disulfides" as used herein excludes carbon disulfide ($CS_2$).

As used herein, the weight percent or ppm of sulfur, e.g., "wppm-sulfur" is the amount of sulfur in a hydrocarbon stream, and not the amount of the sulfur-containing species unless otherwise indicated. As an example, methylmercaptan, $CH_3SH$, has a molecular weight of 48.1 with 32.06 represented by the sulfur atom, so the molecule is about 66.6%, by weight, sulfur. As a result, the actual sulfur compound concentration can be higher than the wppm-sulfur from the compound. An exception is that the disulfide content in caustic can be reported as the wppm of the disulfide compound.

As used herein, the term "mercaptan-tainted caustic" can mean a caustic having a typical level of one or more mercaptans after exiting an extraction zone and prior to treatment in a mercaptan oxidation zone. It may or may not have desired levels of other sulfur-containing compounds, such as one or more disulfides. Typically, "mercaptan-tainted caustic" may have up to about 1,000 wppm of one or more mercaptans.

As used herein, the term "disulfide-tainted caustic" can mean a caustic having been treated in a mercaptan oxidation zone and having desired levels of one or more mercaptans, but still has undesired levels of one or more disulfides. Such a disulfide-tainted caustic can be downstream of a mercaptan oxidation zone and upstream of a disulfide elimination zone. In some exemplary applications if a lowered level of one or more disulfides is not desired, such a stream could be considered a regenerated or lean caustic. Generally, the level of disulfides can be about 150- about 300, wppm in caustic, or higher particularly if the stream is after a mercaptan oxidation zone and upstream of a separation zone.

As used herein, the term "lean caustic" is a caustic having been treated and having desired levels of sulfur, including one or more mercaptans and one or more disulfides for treating one or more C1-C5 hydrocarbons in an extraction zone.

As used herein, the term "regeneration" with respect to a solvent stream can mean removing one or more disulfide sulfur species from the solvent stream to allow its reuse in, e.g., a caustic treatment zone or a disulfide elimination zone.

As used herein, the term "killed carbon steel" generally means a carbon steel deoxidized by the addition of aluminum, ferrosilicon, or other suitable compounds while the mixture is maintained at melting temperature until all bubbling ceases. Typically, the steel is quiet and begins to solidify at once without any evolution of gas when poured into ingot molds.

DETAILED DESCRIPTION

Figure 1:
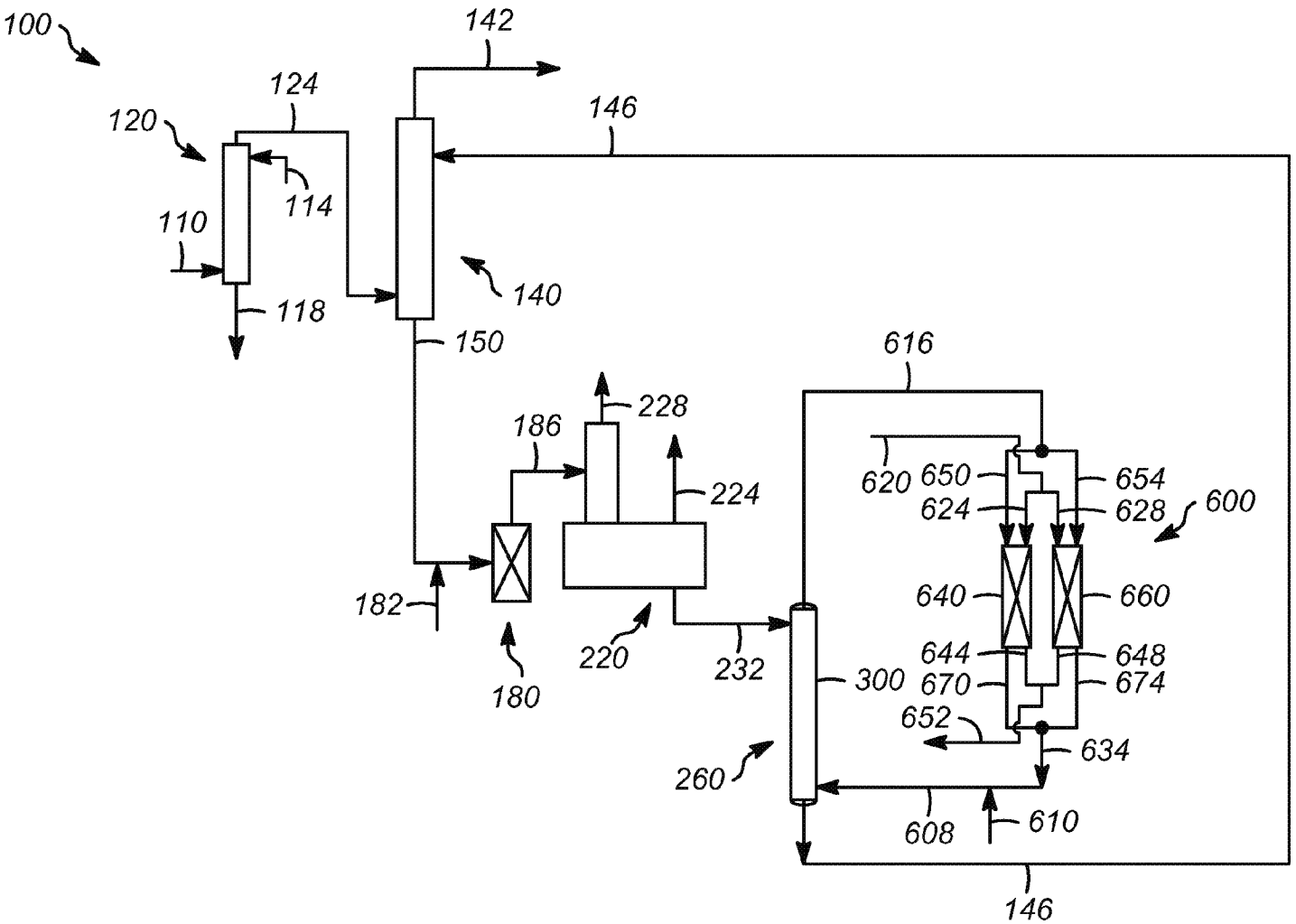
FIG. 1 is a schematic depiction of an exemplary apparatus for extracting one or more sulfur compounds from a hydrocarbon stream.

Referring to FIG. 1, an exemplary apparatus 100 for removing one or more sulfur-containing compounds, such as mercaptans, from a hydrocarbon stream 110 is depicted. Typically, the apparatus 100 can include a caustic prewash zone 120, an extraction zone 140, a mercaptan oxidation zone 180, and a separation zone 220. The vessels, lines and other equipment of the apparatus 100 can be made from any suitable material, such as carbon steel or killed carbon steel. As depicted, process flow lines in the figures can be referred to as lines, pipes or streams. Particularly, a line or a pipe can contain one or more streams, and one or more streams can be contained by a line or a pipe.

Usually, the hydrocarbon stream 110 is in a liquid phase and can include a liquefied petroleum gas or a naphtha hydrocarbon. As such, the hydrocarbon stream 110 typically contains one or more C4 hydrocarbons, but may contain other hydrocarbons, such as at least one of C1-C3 and C5 hydrocarbons. The hydrocarbon stream 110 can include up to about 200 ppm, preferably no more than about 100 ppm, by weight, sulfur in hydrogen sulfide based on the weight of the hydrocarbon stream 110. Typically, the hydrocarbon stream 110 contains sulfur compounds in the form of one or more mercaptans and/or hydrogen sulfide as well as carbonyl sulfide, one or more sulfides, and carbon disulfide. Although not wanting to be bound by theory, usually the hydrogen sulfide and the one or more mercaptans are removable from the hydrocarbon stream 110 in the caustic prewash zone 120 and the extraction zone 140. Generally, the hydrocarbon stream 110 is combined with a caustic solution for removing, e.g., hydrogen sulfide. The caustic can be any alkaline material, and generally includes an aqueous solution of caustic soda, i.e., sodium hydroxide. The hydrocarbon stream 110 can also be passed through a caustic prewash vessel in the caustic prewash zone 120. A fresh caustic stream 114 may also be provided to the caustic prewash zone 120. The hydrocarbon stream 124 that can include one or more C1-C8 hydrocarbons with hydrogen sulfide typically removed into a prewash caustic solution that, in turn, can be removed via the line 118. The caustic stream in a line 118 withdrawn that can optionally at least be partially recycled to the hydrocarbon stream 110. The mixture may be subsequently passed through a static mixer for more efficient hydrogen sulfide removal in the caustic prewash zone 120. Exemplary apparatuses having a hydrocarbon treatment section including a caustic prewash vessel and an extractor vessel for the removal of sulfur species from the hydrocarbon stream, and a caustic regeneration section including an oxidizer reactor and a separation vessel for removing sulfur-containing compounds from the circulating caustic are disclosed in, e.g., U.S. Pat. No. 7,326,333.

The caustic prewash zone 120 can provide a hydrocarbon stream 124 that may be substantially free of hydrogen sulfide that can be provided to the extraction zone 140, and thus minimizing the reaction of caustic and hydrogen sulfide in the extraction zone 140. Optionally, a separate amine unit for hydrogen sulfide removal may be provided upstream of the prewash zone to avoid excess caustic consumption in the prewash at higher hydrogen sulfide levels. Typically, the extraction zone 140 is a mercaptan extraction zone 140. The hydrocarbon stream 124 can enter an extractor vessel in the extraction zone 140. A predominately hydrocarbon phase can rise while the caustic can fall counter-currently, causing intimate mixing at each equilibrium stage and transfer of mercaptan from the hydrocarbon phase to the caustic phase. A mercaptan-tainted caustic 150, i.e., having extracted mercaptans, can be withdrawn from a bottom and a hydrocarbon product stream 142 with little or no hydrogen sulfide and mercaptan can be withdrawn from a top of an extractor vessel.

The mercaptan-tainted caustic 150 can be combined with a stream 182 including oxygen, such as air, and optionally an oxidation catalyst. The oxidation catalyst can be any suitable oxidation catalyst, such as a sulfonated metal phthalocyanine However, any suitable oxidation catalyst can be used, including those described in, e.g., U.S. Pat. No. 7,326,333. The optional oxidation catalyst, the air stream 182, and the mercaptan-tainted caustic 150 can be combined before entering the mercaptan oxidation zone 180. Generally, the rich aqueous caustic and air mixture are distributed in the oxidizer reactor. In the oxidizer reactor, although not wanting to be bound by theory, the sodium mercaptides react with oxygen and water to yield disulfide oil and caustic, i.e., sodium hydroxide, and organic disulfides. Optionally, the oxidizer reactor can include packing, such as carbon rings, to increase the surface area for improving contact between the mercaptan-tainted caustic and catalyst.

Afterwards, an oxidation outlet stream 186 from the oxidizer reactor can be withdrawn. The oxidation outlet stream 186 can include disulfide-tainted caustic, one or more hydrocarbons, one or more sulfur compounds, and a gas. Typically, the oxidation outlet stream 186 can include a gas phase, a liquid disulfide phase, and a liquid aqueous caustic phase. Generally, the gas phase includes air with at least some oxygen depletion. In the gas phase, the oxygen content can be about 5- about 21%, by mole.

The oxidation outlet stream 186 can be received in the separation zone 220. The separation zone 220 can include any suitable process equipment, such as a disulfide separator, and can be operated at any suitable conditions, such as no more than about 60° C. and about 250- about 500 kPa.

A hydrocarbon-disulfide phase, an aqueous caustic phase, and a gas phase including spent air may enter a stack of a disulfide separator in the separation zone 220. Generally, the gas phase separates from the liquid phases. The liquid disulfide and aqueous caustic phases can enter a body of the disulfide separator and segregate. Generally, the disulfide phase can exit as a stream 224 and one or more gases may exit a stack as a stream 228. Usually, at least a majority of the one or more disulfides are separated and removed from the caustic. Often, the caustic phase can exit the bottom of the disulfide separator as a disulfide-tainted caustic stream 232, which in this exemplary embodiment still may have excessive levels of disulfide.

The disulfide-tainted caustic stream 232 can be provided to a caustic treatment zone or a disulfide elimination zone 260 to remove one or more disulfides. Particularly, the caustic treatment zone 260 can substantially remove one or more disulfide compounds. The caustic treatment zone 260 can include a packed column 300 and a plurality of beds 600, typically a plurality of adsorbers 600. The plurality of adsorbers 600 can include a first adsorber 640 and a second adsorber 660. Typically, the adsorbers 640 and 660 can operate with one adsorber operating while the other adsorber idling or regenerating. The adsorbers 640 and 660 can contain any suitable adsorbent for removing one or more disulfides from a solvent.

Figure 2:
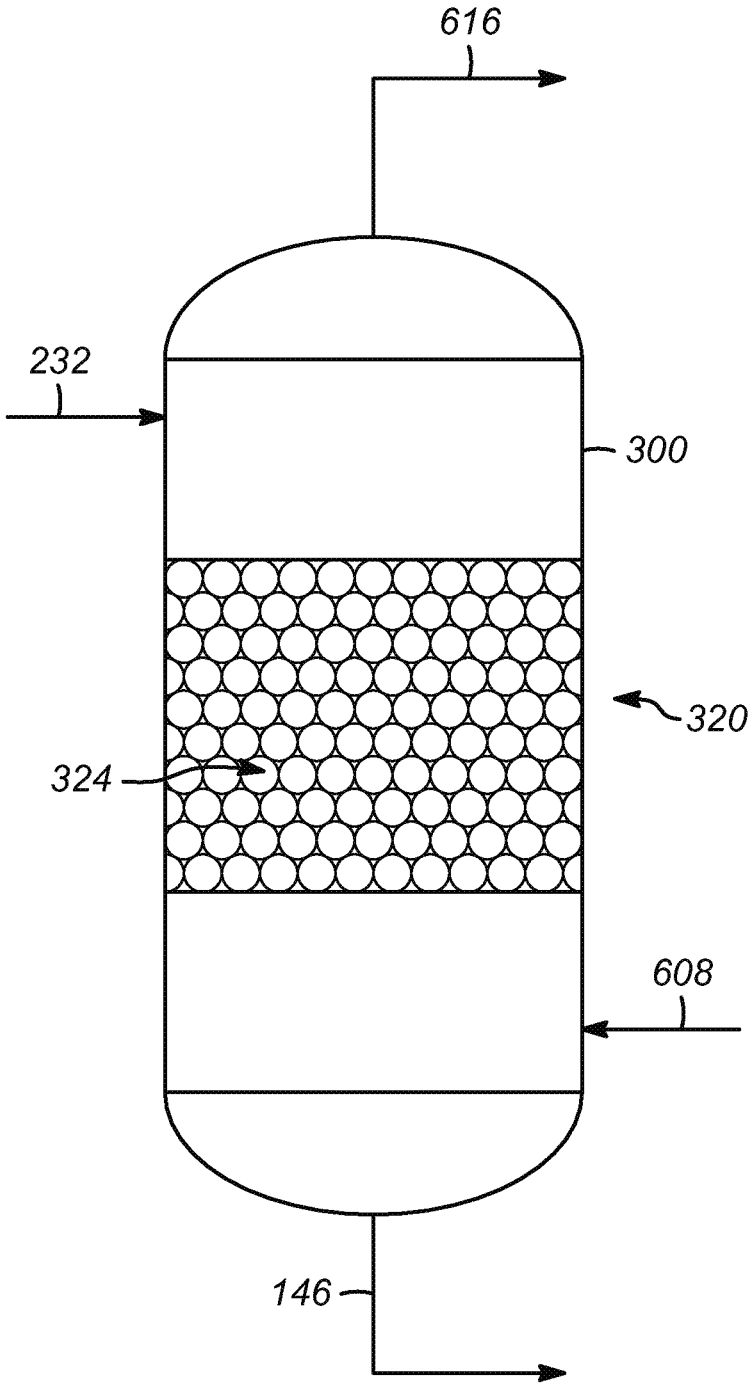
FIG. 2 is a schematic, cross-sectional view of an exemplary packed column.

Referring to FIGS. 1-2, the packed column 300 can be any suitable column including any suitable packing 320. One exemplary packing 320 is a plurality of rings 324, such as RASCHIG packing material sold by Raschig GmbH LLC of Ludwigshafen, Germany. Generally, the plurality of rings 324 can be any suitable substantially inert material with respect to the caustic, such as carbon. Typically, the ring packing can be any suitable dimension, but is typically about 1- about 5 centimeters (may be abbreviated "cm") in diameter. Other types of packing can include structured packing, fiber and/or film contactors, or tray systems, e.g. one or more trays, as long as suitable contact is attained. A further exemplary packing can be an engineered structured packing such as that available under the trade designation HY-PAK by Koch-Glitsch, LP of Wichita, KS, or, e.g., disclosed in US 2008/0085400 and U.S. Pat. No. 5,112,536. Thus, any packing may be suitable that can be effective for facilitating phase contact and mass transfer, and be substantially inert to the caustic stream.

In operation, the disulfide-tainted caustic stream 232 can be provided to the packed column 300. An incoming hydrocarbon-solvent stream 608, including one or more C3-C12 hydrocarbons, such as propane, isobutane, normal butane, liquefied petroleum gas, naphtha, and non-alkene hydrocarbons, can be utilized to adsorb the one or more disulfides by, e.g., counter-currently passing hydrocarbon-solvent with respect to the disulfide-tainted caustic. As an example, the solvent stream can include isobutane and/or normal butane. Generally, the disulfide-tainted caustic stream 232 falls and is stripped by the hydrocarbon in the incoming hydrocarbon-solvent stream 608 rising counter-currently. Afterwards, the regenerated and substantially disulfide free caustic stream 146 may be recycled to the extraction zone 140. Typically, the outgoing hydrocarbon stream 616 passes through a series of valves to enter either the first adsorber 640 or the second adsorber 660. Usually, one adsorber 640 is in operation while the other adsorber 660 is idle or being regenerated. In this example, the outgoing hydrocarbon stream 616 can pass through a first line 650 to the first adsorber 640. Generally, the first adsorber 640 can remove one or more disulfides. Afterwards, a disulfide depleted solvent can pass through the line 670 and proceed as an outgoing disulfide depleted solvent stream 634. Next, the outgoing disulfide depleted solvent stream 634 can be recycled and optionally combined with a fresh makeup solvent stream 610 and be provided as an incoming hydrocarbon-solvent stream 608 to the packed column 300. If the second adsorber 660 is being utilized, the outgoing hydrocarbon stream 616 can pass through the lines 654 and 674 through the second adsorber 660.

To regenerate an adsorber 640 or 660, a fresh regenerate or regenerate stream 620, typically including heated one or more C1-C6 hydrocarbons, such as one or more C3-C4 alkanes or fuel gas, or nitrogen, may be used to regenerate the first adsorber 640 or the second adsorber 660. Generally, a fuel gas would be selected having suitably low levels of one or more sulfur compounds for its use as a regenerant. In this case to regenerate the adsorber 660, the fresh regenerate stream 620 can pass through a line 628 into the second adsorber 660. Afterwards, the spent regenerate can pass through a line 648 and exit as a spent regenerate stream 652. If the first adsorber 640 is being regenerated, the regenerate can pass through the line 624 into the first adsorber 640, exit through the line 644, and exit as spent regenerate stream 652. Valves are not depicted that can be opened and closed to control the flow of the solvent and regenerate through the plurality of adsorbers 600. Typically, the regeneration can take place at a temperature of about 220- about 300° C., preferably about 260° C. As a result, the regenerated and disulfide extracted caustic stream 146 can have no more than about 5 wppm, optimally no more than about 1 wppm total disulfides, based on the weight of the stream 146.

In one exemplary embodiment, the adsorber 640 or 660 may be relatively small vessels, and thus, can have low flow requirements. If other adsorptive removal units are downstream receiving the hydrocarbon product stream 142, for removing, e.g., nitrogen, at least one oxygenate, or sulfur, these units may have much larger flow requirements. In such an instance, both the adsorbers 640 and 660 can share common regeneration equipment, such as a vaporizer, a superheater, and a condenser, with the larger unit. As an example, a small slip stream of fresh regenerant supplied by a downstream unit can comprise the regenerant stream 620 and spent regenerant stream 652, having one or more sulfur compounds removed from the adsorbent during regeneration may be returned to a regenerant condenser in the downstream unit for further processing.

Figure 3:
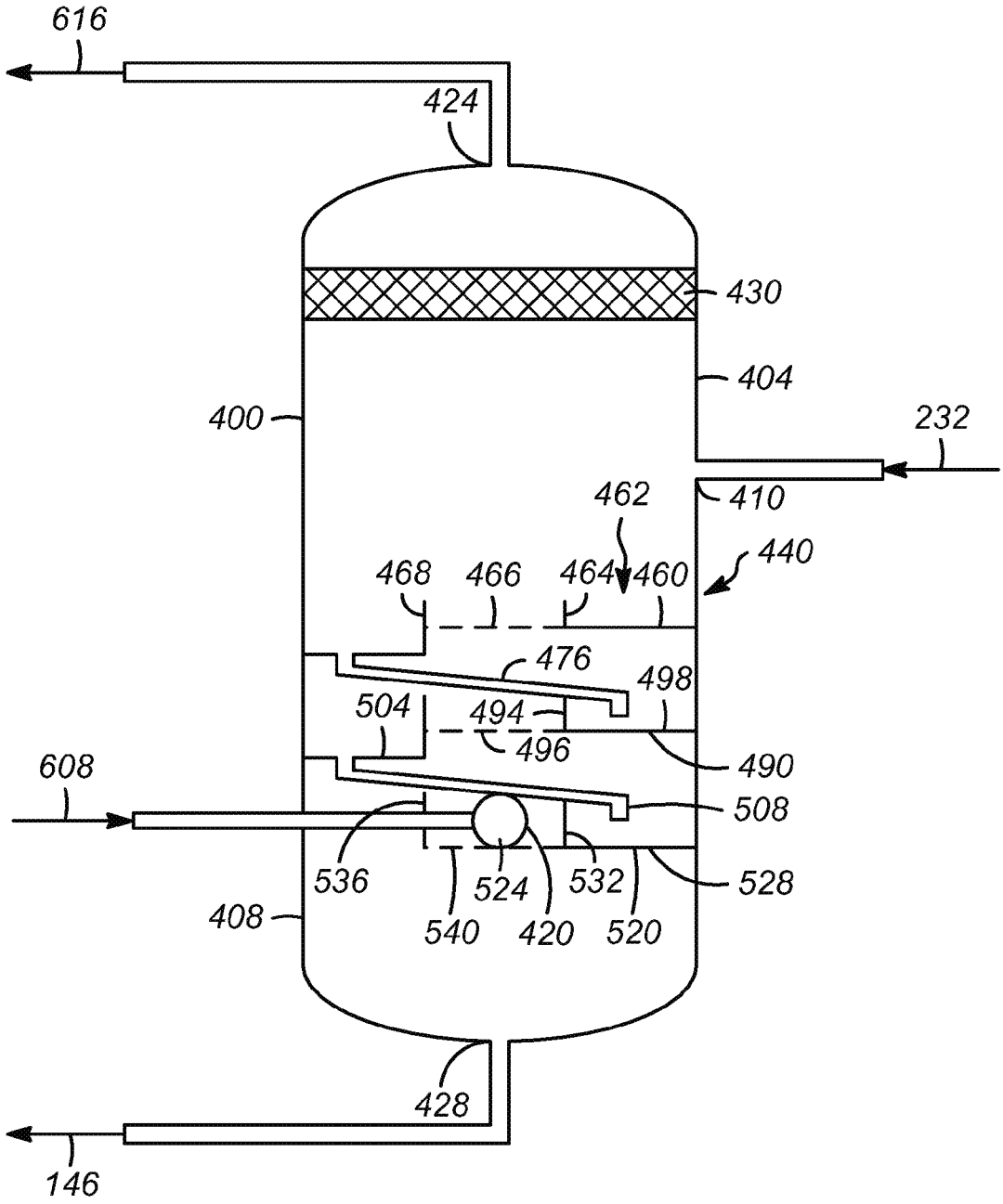
FIG. 3 is a schematic, cross-sectional view of another exemplary column.
Figure 4:
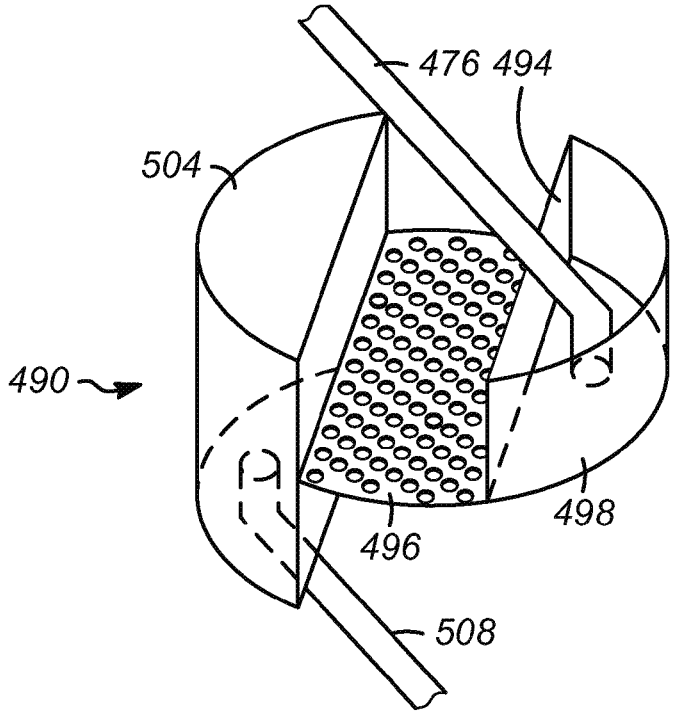
FIG. 4 is a perspective view of an exemplary tray.
Figure 5:
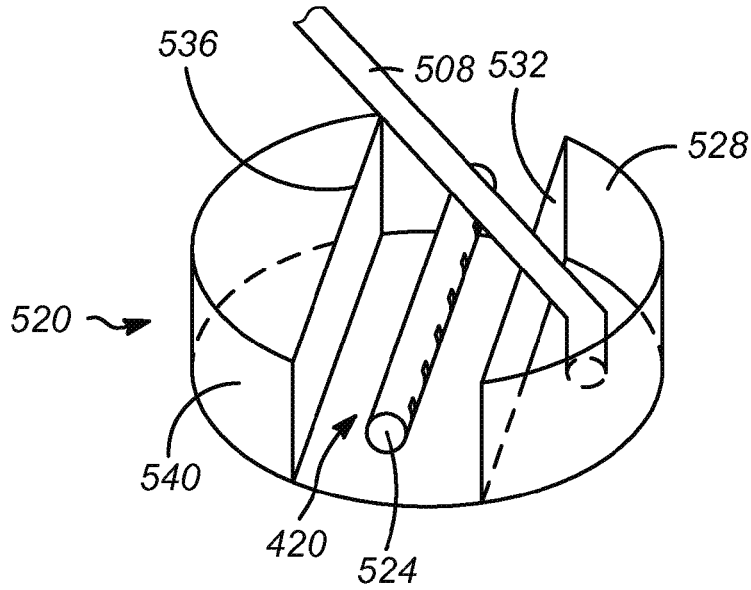
FIG. 5 is a perspective view of another exemplary tray.

Referring to FIGS. 3-5, another exemplary column 400 is depicted. In this exemplary embodiment, the packed column 300, as depicted in FIG. 1, can be replaced with the column 400, and is depicted in FIG. 3 as viewed from the back with respect to the depiction in FIG. 1. Generally, the column 400 has a top 404 and a bottom 408, and may include a coalescer 430, and a plurality of trays 440. Moreover, the column 400 can have a caustic inlet 410, a caustic outlet 428, a hydrocarbon inlet 420, and a hydrocarbon outlet 424. Usually, the coalescer 430 can be any suitable device such as a metal mesh made of any suitable material, such as carbon or stainless steel. The plurality of trays 440 may include a first tray 460, a second tray 490, and a third tray 520, although any suitable number of trays may be utilized, such as at least one tray. Exemplary trays are depicted in, e.g., U.S. Pat. No. 7,381,309 B1.

The first tray 460 can include a weir 464 and an outlet pan 468. Typically, the walls of the column 400, the first tray 460, and the weir 464 can define an inlet pan 462 for receiving, e.g., the disulfide-tainted caustic stream 232. Other pans, as described below, can also be defined by corresponding weirs and the walls of the column 400. A plate 466 forming a plurality of openings can couple the outlet pan 468 with the weir 464. Generally, a downcomer 476 can be coupled to the bottom of the outlet pan 468.

The second tray 490 may also include a weir 494, a plate 496 forming the plurality of openings, an inlet pan 498, and an outlet pan 504. Generally, the second tray 490, the weir 494, and the walls of the column 400 define the inlet pan 498. Usually, the plate 496 can be coupled to the outlet pan 504, which in turn, can be coupled to downcomer 508.

The third tray 520 can include a first pan 528, a first weir 532, a second weir 536, and a second pan 540. Generally, the first pan 528 can receive fluid from the downcomer 508. The incoming hydrocarbon-solvent stream 608 can be provided through the hydrocarbon inlet 420, which typically can take the form of a distributor 524.

In operation, the disulfide-tainted caustic stream 232 can pass into the column 400 and the incoming hydrocarbon-solvent stream 608 can enter at the distributor 524 onto the third tray 520. Typically, the disulfide-tainted caustic passes downward through the column 400 via the downcomers 476 and 508 and the incoming hydrocarbon-solvent may pass upwards through the openings in the plates 496 and 466 with mixing of the hydrocarbon and caustic occurring in the column 400 resulting in the transfer of one or more disulfides from the caustic to the hydrocarbon-solvent. On the third tray 520, typically the caustic overflows the first weir 532 and the second weir 536 and falls to the bottom 408 of the column 400. Afterward, the lean caustic may exit as the regenerated and disulfide extracted caustic stream 146 and be provided to the extraction zone 140. As the hydrocarbon-solvent rises to the top 404 of the column 400, the hydrocarbon-solvent may pass through the coalescer 430 where any entrained caustic can be separated and fall back down through the column 400. Afterwards, the hydrocarbon-solvent can exit through the hydrocarbon stream outlet 424 as the outgoing hydrocarbon stream 616.

In an alternative embodiment, a solvent to enhance extraction of disulfides from the disulfide-tainted caustic may also be introduced upstream of the mercaptan oxidation zone 180 into the mercaptan-tainted stream 150, depending on the type of solvent used. In such an instance, the solvent may exit in the stream 224 from the separation zone 220.

As a result of lowering the overall sulfur in the apparatus 100, a hydrocarbon product stream 142 can have less than about 10, preferably less than about 2 ppm, by weight, sulfur, in the form of one or more mercaptans and disulfide sulfur-containing compounds. Generally, the disulfides in the disulfide-tainted caustic stream 232 entering the column 300 or 400 can be about 150- about 300, wppm, and exiting as the stream 146 at no more than about 5, wppm, of one or more disulfides based on the weight of, respectively, the streams 232 and 146. Due to this lower level of sulfur in the regenerated and disulfide extracted caustic stream 146, the hydrocarbon product stream 142 can have a low level of sulfur, such as no more than about 1, wppm-sulfur, preferably no more than about 0.5, wppm-sulfur, present in a species of one or more mercaptans, and no more than about 2.5, wppm-sulfur, preferably no more than about 1.0, wppm-sulfur, present in a species of one or more disulfide compounds, based on the weight of the hydrocarbon product stream 142.

With respect to other sulfur compounds, dimethylsulfide (may be abbreviated herein as "DMS") is generally present in low levels in a C4 cut, such as no more than about 1 wppm-sulfur in DMS. Usually, DMS is a C5 boiling range species and is present at trace levels because typically the feed to the apparatus is a C4 cut from a fractionator that generally has a low level of residual C5 content, such as about 0.5%, by weight, of one or more C5 hydrocarbons. However, higher residual C5 levels can allow for increased amounts of DMS. DMS is typically not extracted by caustic and may pass through the apparatus 100 as an inert similar to a hydrocarbon.

Generally, carbonyl sulfide (may be abbreviated "COS") is present in low levels in a C4 cut, such as about 1 wppm-sulfur in COS, and thus is usually present in trace levels to a feed to the apparatus 100. Typically, COS is a C3 boiling range species and may be present at trace levels because a C4 cut from a fractionator generally has a low level of residual C3 content, such as about 0.5%, by weight, of one or more C3 hydrocarbons. Typically, COS is not extracted by caustic and can pass through the apparatus 100 as an inert.

Consequently, by removing disulfides from the caustic, significant amounts of the disulfides do not transfer into the hydrocarbon product stream 142. As a result, the overall sulfur content of the hydrocarbon product stream 142 can be lowered and may avoid negative consequences in downstream catalytic units effected by sulfur, avoidance of an additional sulfur removal zone (such as an adsorptive removal zone) to meet feedstock sulfur specifications of a unit downstream of the apparatus 100, or reduce the size and cost of an additional sulfur removal zone, if required.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for removing one or more disulfide compounds from a caustic stream, comprising:

A) passing the caustic stream, previously contacted with a hydrocarbon stream for removing one or more mercaptans, through a column to remove the one or more disulfide compounds downstream of a mercaptan oxidation zone; wherein the caustic stream is provided counter-current to a solvent stream comprising one or more C3-C12 hydrocarbons;

B) passing the solvent stream to a plurality of beds for removal of extracted one or more disulfides from the solvent before recycling to the column.

2. The process according to claim 1, wherein the column comprises a packed column containing a packing

3. The process according to claim 2, wherein the packing comprises a plurality of rings.

4. The process according to claim 1, wherein the column comprising a plurality of trays, and at least one tray comprises a pan coupled to a downcomer.

5. The process according to claim 1, wherein the plurality of beds comprises an adsorbent effective for removal of one or more disulfides from the solvent stream.

6. The process according to claim 1, wherein the solvent stream comprises propane or naphtha.

7. The process according to claim 1, wherein the solvent stream comprises at least one of isobutane and normal butane.

8. The process according to claim 1, further comprising providing a regenerant stream to the plurality of beds.

9. The process according to claim 8, wherein the regenerant stream comprises one or more C1-C6 hydrocarbons.

10. The process according to claim 8, wherein the regenerant stream comprises a fuel gas.

11. The process according to claim 8, wherein the regenerant stream comprises one or more C3-C4 alkanes.

12. The process according to claim 8, wherein the regenerant stream comprises nitrogen.

13. A process for removing one or more disulfide compounds from a caustic stream, comprising:

A) passing the caustic stream, previously contacted with a hydrocarbon stream for removing one or more mercaptans, through a packed column to remove the one or more disulfide compounds downstream of a mercaptan oxidation zone;

B) passing a solvent stream, in turn, comprising one or more $C_3$-$C_{12}$ hydrocarbons counter-current to the caustic stream in the packed column; and C) passing the solvent stream through an adsorber to remove the one or more disulfide compounds before recycling to the packed column.

14. The process according to claim 13, wherein the packed column comprises a packing effective for facilitating phase contact and mass transfer, and substantially inert to the caustic stream.

15. A process for removing the one or more disulfide compounds from a caustic stream, comprising:

A) passing the caustic stream, previously contacted with a hydrocarbon stream for removing one or more mercaptans, through a column having one or more trays to remove the one or more disulfide compounds downstream of a mercaptan oxidation zone; wherein at least one tray forms a pan communicating via a downcomer with an adjacent tray;

B) passing a solvent stream, in turn, comprising one or more $C_3$-$C_{12}$ hydrocarbons counter-current to the caustic stream in the column; and C) passing the solvent stream through an adsorber to remove the one or more disulfide compounds before recycling to the column.

* * * * *